United States Patent [19]

Russell

[11] 4,114,547

[45] Sep. 19, 1978

[54] STITCH SHORTENING AND TACKING ASSEMBLY

[75] Inventor: Richard Russell, Tappan, N.Y.

[73] Assignee: U.S. Blind Stitch Machine Corp., Plainview, N.Y.

[21] Appl. No.: 836,253

[22] Filed: Sep. 23, 1977

[51] Int. Cl.[2] ..... D05B 1/24; D05B 27/22

[52] U.S. Cl. ..... 112/178; 112/210; 112/212; 112/214

[58] Field of Search ..... 112/176, 178, 203, 209, 112/210, 212, 214, 271, 276, DIG. 3

[56] References Cited

U.S. PATENT DOCUMENTS

| | | | |
|---|---|---|---|
| 3,011,462 | 12/1961 | Ritter et al. | 112/210 |
| 3,064,604 | 11/1962 | Moro | 112/210 |
| 3,411,468 | 11/1968 | Roth | 112/178 |
| 3,677,208 | 7/1972 | Fletcher et al. | 112/178 |
| 3,834,334 | 9/1974 | Adams et al. | 112/210 |

*Primary Examiner*—Werner H. Schroeder
*Assistant Examiner*—Moshe I. Cohen
*Attorney, Agent, or Firm*—Blum, Moscovitz, Friedman & Kaplan

[57] ABSTRACT

A stitch shortening and tacking assembly for use in a sewing machine is provided. The shortening and tacking assembly is particularly suited for use with a sewing machine wherein a fabric is advanced between a presser foot and a platen disposed in a first feeding position by a reciprocating feeder that is synchronized with respect to a rib and sewing needle. The sewing needle is synchronized with respect to the feeder and rib to stitch the fabric after the web has been advanced by the feeder. The platen is adapted to be displaced from the feed position to a stitch shortening position whereby the web is advanced through a shorter interval between sewing operations to thereby shorten the length of each stitch effected thereby. The platen is further adapted to be displaced from the stitch shortening position to a stitch tacking position whereby a portion of the platen is biased against the presser foot to thereby prevent the fabric from being advanced between sewing operations.

16 Claims, 8 Drawing Figures

STITCH SHORTENING AND TACKING ASSEMBLY

BACKGROUND OF THE INVENTION

This invention is directed to a stitch shortening and tacking assembly for use in a sewing machine, and, in particular, to a stitch shortening and tacking mechanism for use in a blind stitch sewing machine for selectively varying the amount of advancement of the fabric to provide a shortened stitching operation or stitch tacking operation thereby.

Blind stitch sewing machines for performing a single threaded chain stitch sewing operation are well known in the art. However, prior art blind stitch sewing machines have been found to be less than completely satisfactory in at least two respects. First, when it is desired to reduce the stitch length, during a sewing operation, heretofore, the reduction in stitch length has been manually effected, often resulting in the unlocking and unraveling of the single thread chain stitch during normal handling of the sewn fabric. Secondly, these machines lack a tacking mechanism that permits a more secure locking of the single thread chain stitch at the end of the sewing operation by superimposing the stitches upon each other. Accordingly, a stitch shortening and tacking mechanism that is suitable for use with a blind stitch sewing machine is desired.

SUMMARY OF THE INVENTION

Generally speaking, in accordance with the instant invention, a variable stitching assembly for use with a sewing machine of the blind stitch variety, is provided. The sewing machine includes a platen disposed in a first position for supporting a fabric during a sewing operation. A feeder is adapted to be reciprocated through a feeding stroke and a return stroke. The feeder is adapted to engage the fabric against the platen when the platen is in the first position and the feeder is reciprocated through a feeding stroke to thereby advance the fabric through a first predetermined distance. A sewing needle is synchronized with respect to the feeder for stitching the fabric at the completion of each feeding stroke of the feeder. A rib is adapted to be reciprocated in synchronism with the needle through a lift stroke that is shorter than the feed stroke of the feeder and through a return stroke so that the rib lifts the web during each lift stroke thereof. A first platen displacement mechanism is coupled to the platen for displacing same from its first position to a stitch shortening position out of engagement with the feeder during the feed stroke thereof so that the fabric is advanced by the rib through a shorter distance than the first predetermined distance to thereby shorten the length of the stitch effected when the fabric is stitched at the completion of the feeding stroke of the feeder.

The variable stitching assembly is further characterized by a presser foot constructed and arranged to permit the fabric to be advanced between same and the platten when the platten is disposed in a first position and a second platten displacement mechanism coupled to the platen. The second platen displacement mechanism is adapted to coordinately displace the platen between a stitch shortening position and a stitch tacking position whereby a portion of the platen, and hence the fabric adjacent thereto, is biased against the presser foot to thereby prevent the fabric from being advanced between respective sewing operations.

Accordingly, it is an object of the instant invention to provide an improved stitch shortening assembly for reducing the length of a stitch during a sewing operation.

A further object of the instant invention is to provide an improved tacking assembly for preventing fabric from being fed during a sewing operation so that consecutive stitches are superimposed upon each other.

Still a further object of the instant invention is to provide a combined stitch shortening and tacking assembly for a blind stitch sewing machine.

Still another object of the instant invention is to provide a stitch shortening and tacking assembly that controls the positioning of a platen to effect respective shortening and tacking operations.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
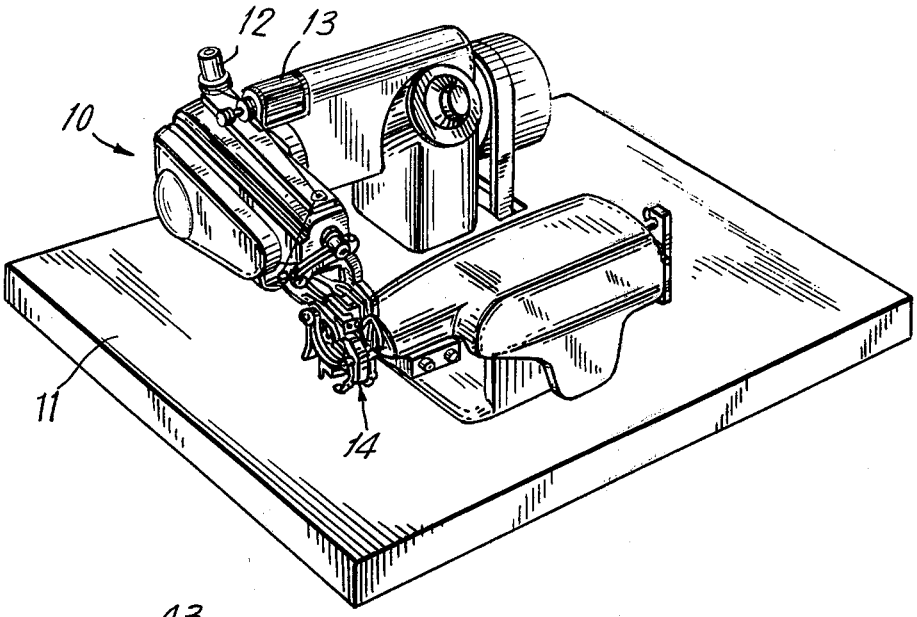
FIG. 1 is a perspective view of a blind stitch sewing machine including a stitch shortening and tacking assembly, constructed in accordance with a preferred embodiment of the instant invention.

Reference is now made to FIG. 1, wherein a blind stitch sewing machine, generally indicated as 10, incorporating a stitch shortening and tacking assembly, generally indicated as 14, is depicted. The blind stitch sewing machine is supported on a platform 11 and includes a pneumatic system (not shown) supported beneath the platform for operating the stitch shortening and tacking assembly, depicted in detail in FIGS. 2 through 7, and a pneumatic tensioner, generally indicated as 13, that can be utilized, in a manner to be described in greater detail below, with the stitch shortening and tacking assembly of the instant invention in order to control excess thread caused by the reduction in the amount of material fed when the stitch shortening and tacking assembly is effecting a stitch shortening or stitch tacking operation. With the exception of the stitch tacking and shortening assembly of the instant invention, the blind stitch sewing machine, depicted in FIG. 1, is adapted to provide a single thread chain stitch sewing operation of the type well known in the art, it being noted that the instant invention is not limited to a blind stitch sewing operation, but can also be utilized in combination with other type sewing machine operations.

Figure 3:
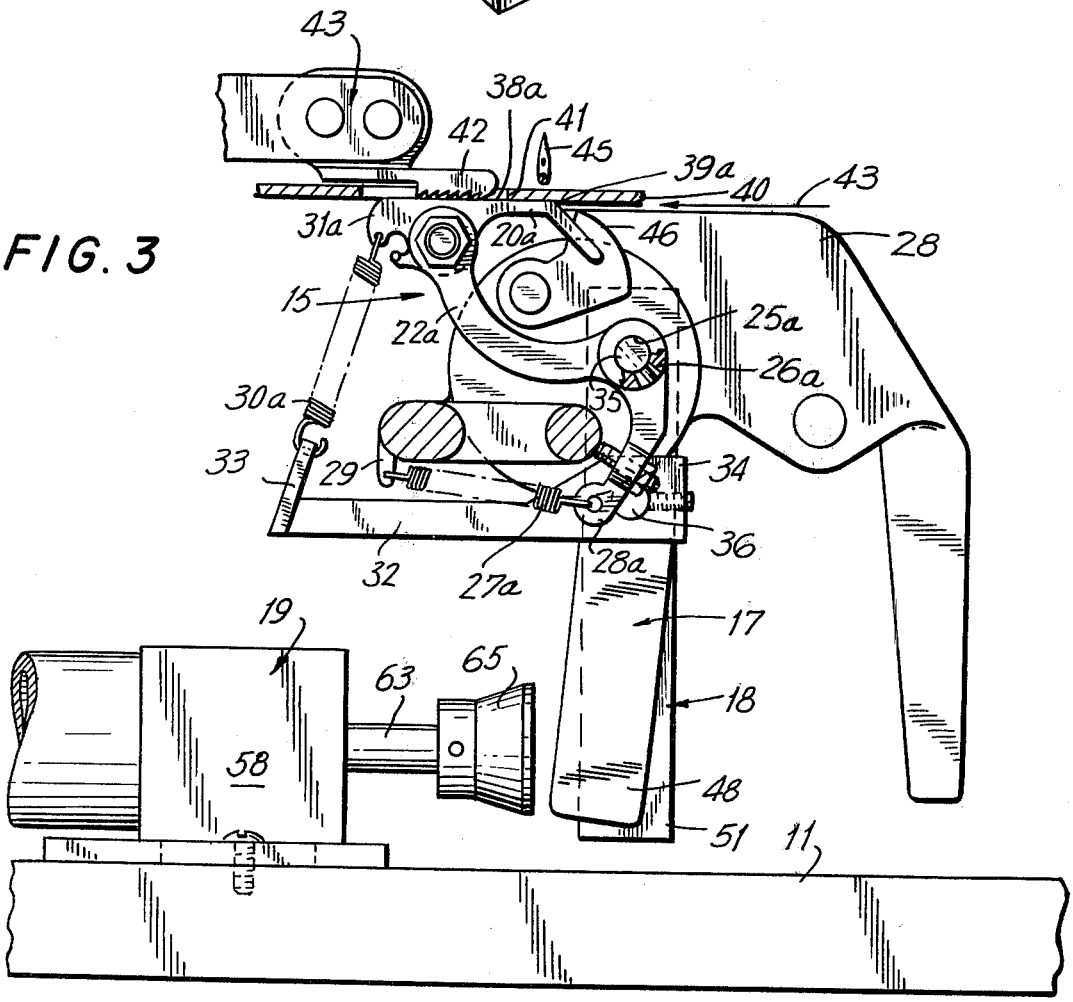
FIG. 3 is a sectional view taken along line 3—3 of FIG. 2, depicting the stitch shortening and tacking assembly of the instant invention in a first operative mode.
Figure 2:
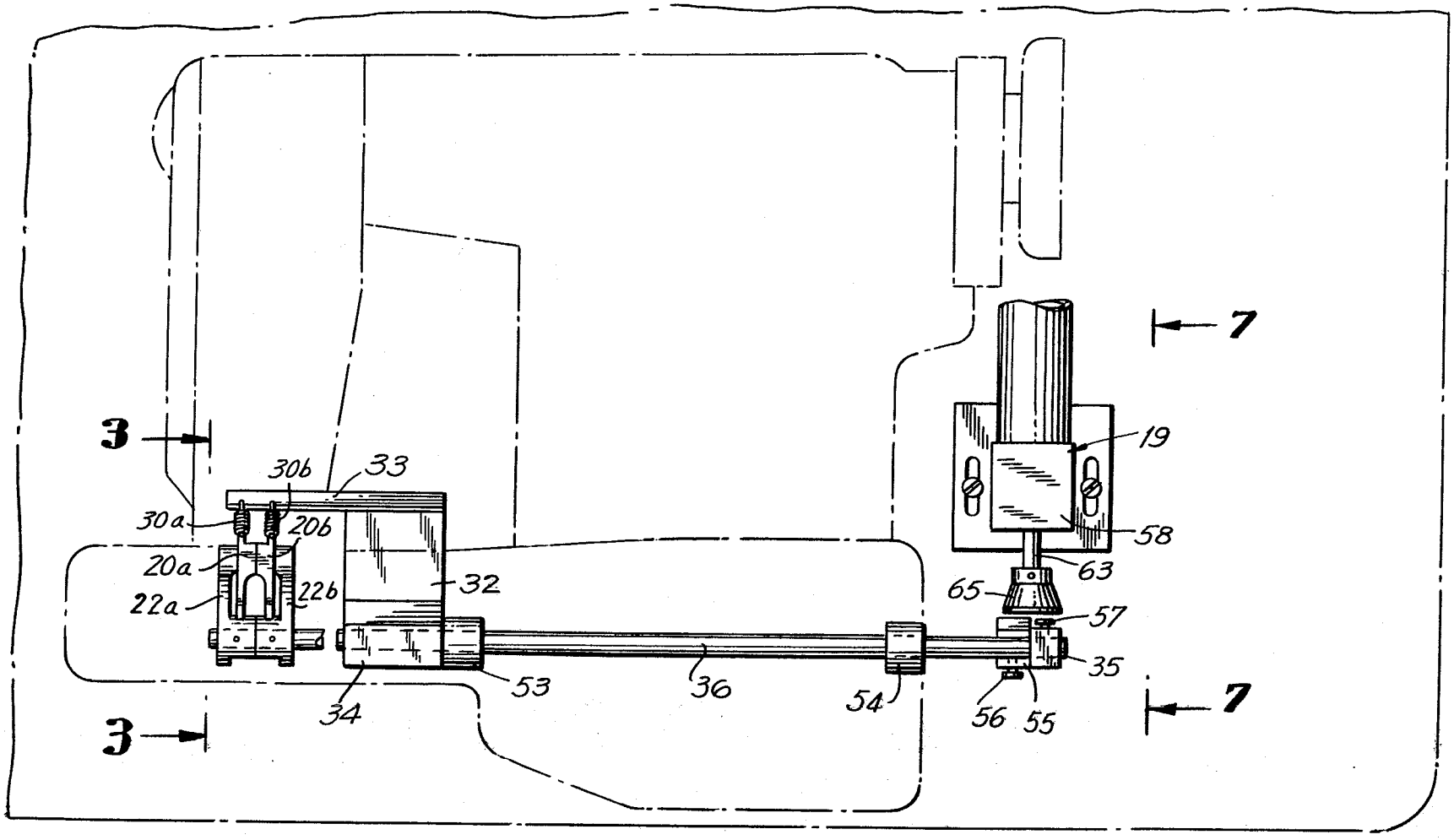
FIG. 2 is a plan view of the stitch tacking and shortening assembly of the instant invention.

Reference is now made to FIGS. 2 and 3, wherein the stitch shortening and tacking assembly, of the instant invention, is depicted in detail. The stitch shortening and tacking assembly is comprised of the platen assembly, generally indicated as 15, a stitch shortening platen displacement mechanism, generally indicated as 17, stitch tacking platen displacement mechanism, generally indicated as 18, and a pneumatic actuating mechanism, generally indicated as 19.

Figure 6:
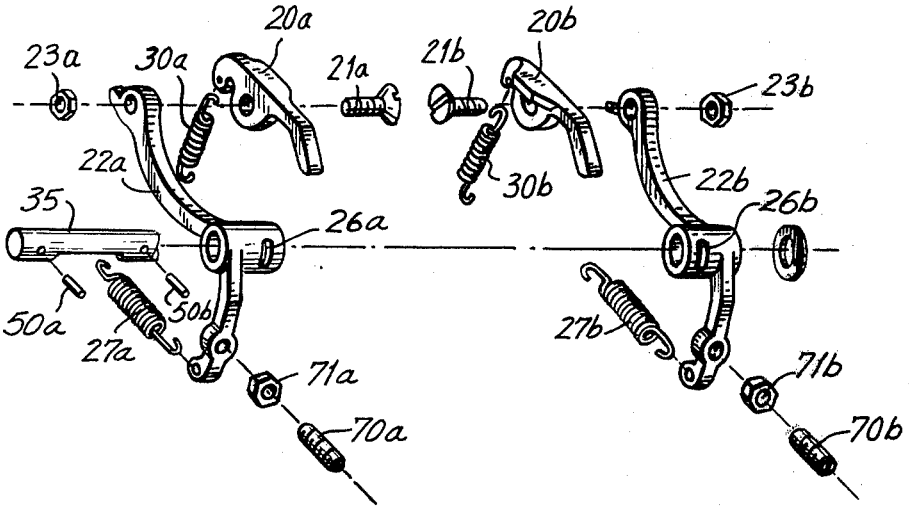
FIG. 6 is an exploded perspective view of a platen assembly for use in the stitch shortening and tacking assembly of the instant invention.
Figure 7:
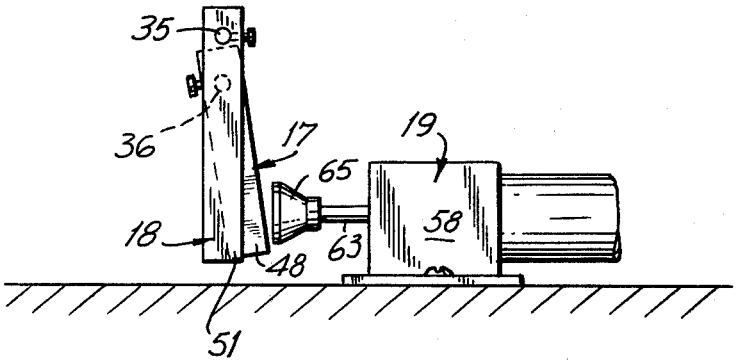
FIG. 7 is a partial elevational side view taken along line 7—7 of FIG. 2.

The platen assembly 15, is depicted in detail in FIG. 6, and includes two platen 20*a* and 20*b* formed in mirror image with respect to each other. Each of the remaining elements of the platen assembly are also formed in mirror image, and, accordingly, in order to facilitate discussion of same herein, reference is made to the elements identified by a reference numeral and the letter *a*, it being understood that each of the elements having the same reference numeral followed by the letter *b* are identical in mirror image, with respect to its counterpart element. Platen 20*a* is pivotably secured to platen lever 22*a* by a screw 21*a* and a hex nut 23*a*. The platen lever 22*a* includes a collar 25*a* having a curved keying slot 26*a* for permitting the platen lever 22*a* to be keyed to a stitch tacking platen shaft 35, in a manner to be discussed in greater detail below. A biasing spring 27*a* is secured to a free end 28*a* of the platen lever 22*a* and is further secured to a fixed projection 29 on the sewing machine feed frame 28 in order to resiliently bias the platen lever 22*a* and, hence, the platen in a clockwise direction, as seen in FIG. 3, about the stitch tacking displacement shaft 35. A biasing spring 30*a* is secured to a projecting portion 31*a* of the platen 20*a*, and is further secured to a bent portion 33 of a connecting arm 32, which connecting arm includes a shoulder portion 34, coupled to stitch shortening displacement shaft 36 in order to be pivotably controlled thereby in a manner to be discussed in greater detail below. A limit screw 70*a* and hex nut 71*b* are provided for limiting the position of the platen assembly with respect to the presser foot.

The platen 20*a* includes a flat guiding surface 38*a* and a pointed toe portion 39*a*. When the stitch shortening and tacking assembly is disposed in a normal operating mode, the flat guiding surface 38*a* is biased by spring 27*a* into flush engagement with the presser foot 40, to permit a fabric, represented by the arrow 43, to be inserted therebetween and advanced in the direction of the arrow 43. The presser foot 40 includes an opening 41 therein, which opening permits a feeder 42 to be selectively disposed therein in abutting engagement with the platen 20*a* and 20*b*. Specifically, the feeder is reciprocated in a substantially elliptical path by a feeder drive assembly, generally indicated as 43, in order to advance the fabric in the direction of the arrow 43. When the feeder is advancing the fabric during a feed stroke, it engages the fabric between itself and the platen, and thereby advances the fabric through a predetermined distance. Thereafter, the feeder is lifted from the fabric and reciprocated through a return stroke. A curved sewing needle 45, of the type found in blind stitch sewing machines, is positioned upstream of the feeder 42, and is adapted to effect a stitching operation after each advancement of the fabric by the feeder 42. Also, a rib 46 is mounted to a shaft of the sewing machine mechanism and is reciprocated in synchronism with the needle 45 in order to effect a lifting of the fabric into the path of the needle, to determine the amount of needle penetration in order to permit single thread chain stitching to be performed in the required blind stitching manner.

Accordingly, when the stitch shortening and tacking assembly is operating in the usual manner, the flat guiding surfaces 38*a* and 38*b* of the platens 20*a* and 20*b*, respectively, are disposed in flush engagement with the presser foot, so that the web of the fabric is tightly clamped therebetween to tightly grip the fabric during the return stroke of the feeder. Each feed stroke of the feeder 42 in the feed direction effects an advancement of the fabric through a predetermined distance equal to the feed stroke of the feeder. The advancement is effected by the feeder engaging the fabric and pressing against the flat guiding surface of the platen to thereby pull the fabric during the feed stroke displacement of the feeder. The rib 46 is reciprocated in synchronism with the feeder 43 and the needle 45 to lift the fabric after the feed stroke of the feeder. It is noted, however, that the reciprocating displacement of the rib 46, in the direction of advancement of the fabric, is considerably less than that of the feeder during each feed stroke. Upon the completion of the feed stroke of the feeder, the sewing needle 45 and rib 46 complete a sewing operation that results in a single thread chain stitch having a length determined by the predetermined distance through which the fabric is advanced by the feeder between sewing operations.

Reference is now made to FIGS. 2 through 7, wherein the stitch shortening and tacking assembly of the instant invention, and the manner in which same operates, is illustrated in detail. As aforenoted, the stitch shortening platen mechanism, generally indicated as 17, includes a shaft 36 for supporting the platen assembly, and a camming rod 48 at the other end thereof. The camming rod 48 is positioned to be engaged by a rubber stopper 65 and, in response thereto, to effect a pivoting of shaft 36.

The stitch tacking platen mechanism, generally indicated as 18, includes a stitch tacking displacement shaft 35 having keying pins 50*a* and 50*b* projecting therefrom to be received in the curved slots 26*a* and 26*b* of the collar 25 of the respective platen levers 22*a* and 22*b*. Accordingly, the platen levers are keyed to the shaft 35, in order to be rotated thereby, in a manner to be discussed in greater detail below. The stitch tacking platen mechanism 18 is further comprised of a stitch tacking camming rod 51, disposed at the end of the shaft 36 that is remote from the platen assembly, at a position with respect to rubber stopper 65, to permit the rubber stopper 65 to engage same and effect a pivoting of the camming rod 51 and, hence, a rotation of shaft 36 thereby. The shafts 35 and 36 are disposed in overlapping relationship, when seen in plan view, and are maintained in position by rotary guides 53 and 54. Additionally, the camming rods 48 and 51 are respectively secured to shafts 35 and 36 by screws 56 and 57, respectively.

Figure 5:
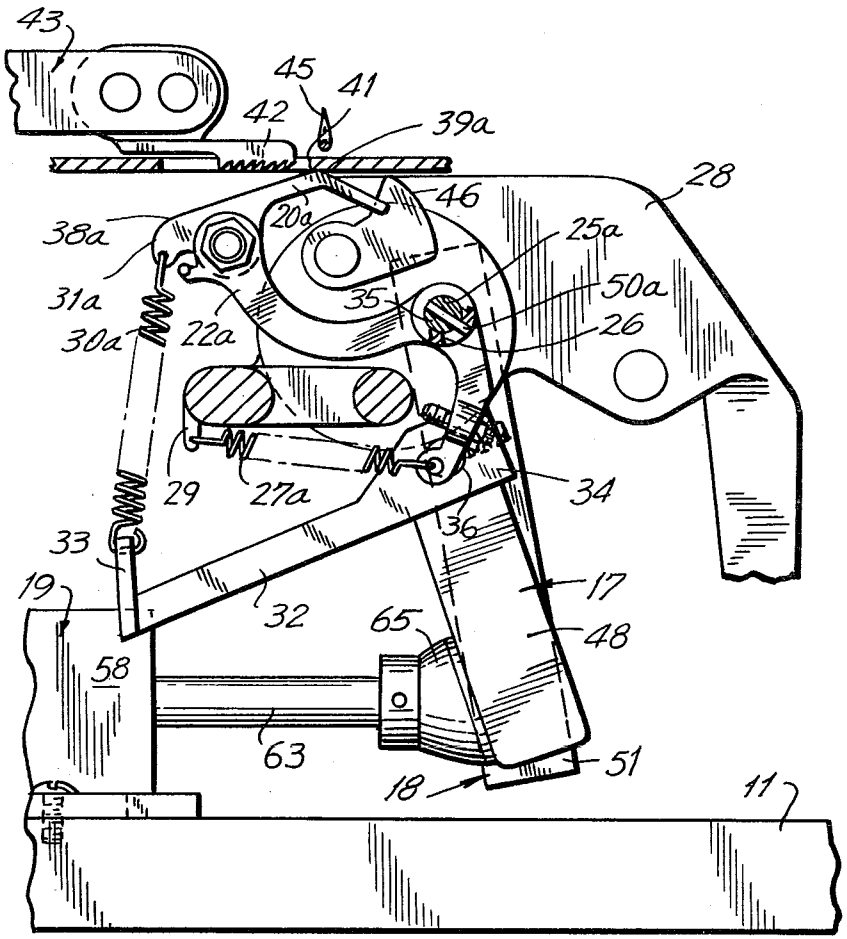
FIG. 5 is a sectional view taken along line 3—3 of FIG. 2, depicting the stitch shortening and tacking assembly of the instant invention in still a further operative mode.
Figure 4:
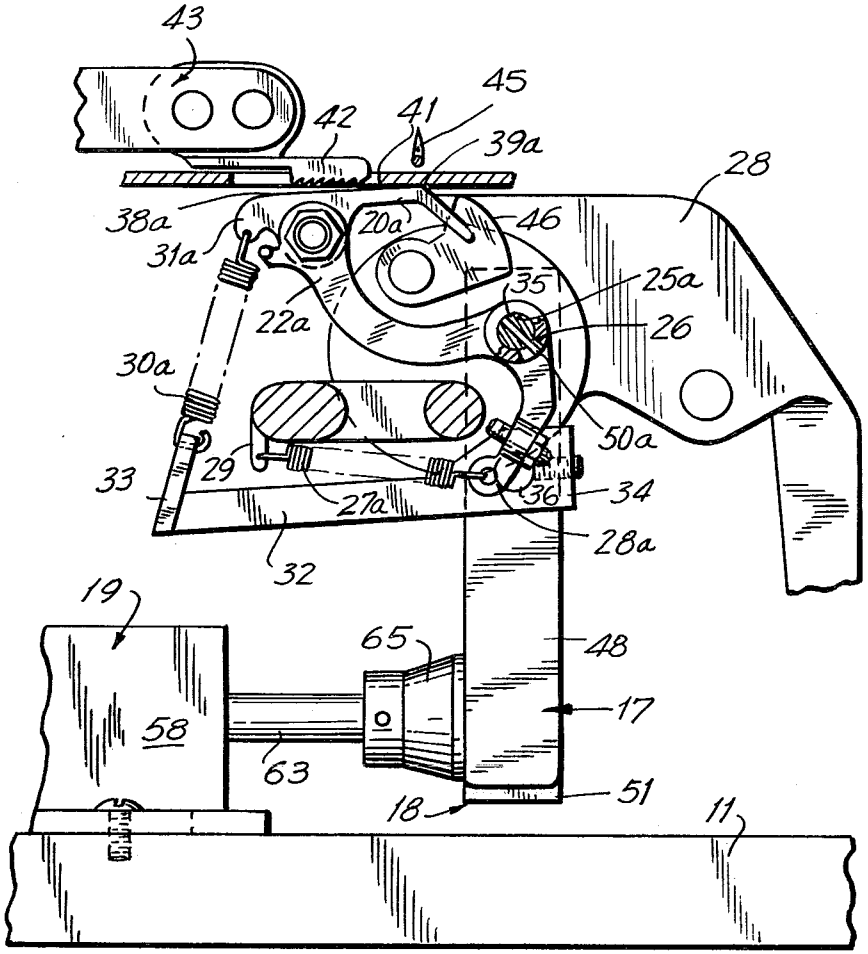
FIG. 4 is a sectional view taken along line 3—3 of FIG. 2, depicting the stitch shortening and tacking assembly of the instant invention in a second operative mode.

The pneumatic mechanism, generally indicated as 19, includes a pneumatically driven air cylinder 58, that can be controlled by the operator of the sewing machine. Rubber stopper 65 is secured to a shaft 63, which shaft is controlled by the air cylinder 58 in order to effect a longitudinal displacement thereof. FIGS. 3, 4 and 5 of the drawings respectively illustrate the three stitch control positions of the rubber stopper 65. When the rubber stopper is out of engagement with the camming rods 50 and 51, in the manner indicated in FIG. 3, the sewing machine operates in a normal mode with the fabric being advanced and sewn in the manner discussed in detail above. The rubber stopper is adapted to be displaced to a stitch shortening position, illustrated in FIG. 4, wherein same engages both camming rods 48 and 51 and positions same in a substantially vertical position. Finally, the rubber stopper can be displaced to a stitch tacking position whereby the camming rods 48 and 51 are both pivoted thereby, in a counterclockwise direction, as viewed in FIG. 5, in order to displace the respective camming rods to the position depicted in FIG. 5. It is noted that when the rubber stopper is returned from the stitch shortening position, depicted in FIG. 4, or the stitch tacking position, depicted in FIG. 5, to a normal advancement position, the biasing springs 27*a* and 27*b* return the platen levers 22*a* and 22*b*, respectively, to a normal advancement position whereby the flat guiding surfaces 38*a* and 38*b* of the platen are biased flush against the presser foot to thereby return the entire platen assembly to a normal advance position.

Accordingly, a stitch shortening operation is effected in the following manner. Air cylinder 58 effects a displacement of the rubber stopper 65 to the stitch shortening position, depicted in FIG. 4. The rubber stopper engages the camming rod 48, and displaces same from the normal advance position of the stitch shortening position, to thereby articulate a rotation through the stitch shortening displacement shaft 36 to the respective connecting arm 32. The rotation of the connecting arms in a counterclockwise direction, as seen in FIG. 4, causes the biasing springs 30*a* and 30*b* to pull down the platens 20*a* and 20*b*, out of biasing engagement with the feeder 42 and the presser foot 41. As a result of the platens being pulled down, the feeder 42 will no longer engage the fabric against the platen during each feeding stroke thereof and, accordingly, no advancement of the fabric will be effected thereby between each sewing operation. It is noted, however, that the rib 46 continues to reciprocate and lift the fabric and, hence, by lifting the fabric advances the fabric by an increment that is considerably shorter, when compared with the increment that the fabric is advanced by the feeder 42, when the sewing machine is in a normal advancement mode of operation. The fabric will be advanced through a shorter distance, thereby shortening the length of each stitch effected by the sewing operation after the feeder 42 has completed its feed stroke. It is noted that a pneumatic tensioner 13 is provided for use in combination with the stitch shortening and tacking assembly to control the excess thread caused by the reduced increment through which the fabric is fed. Specifically, if the same amount of thread were utilized for each sewing operation, when a stitch shortening operation is effected, a build up of excess thread would result. Accordingly, the standard thread tensioner 12 provided in blind stitch sewing machines is supplemented by a pneumatic tensioner 13 that is activated by the pneumatic control mechanism (not shown) at the same time that the air cylinder effects displacement of the rubber stopper to the stitch shortening position.

When a stitch tacking operation is desired, the rubber stopper 65 is displaced by the air cylinder to a stitch tacking position, indicated in FIG. 5, to thereby effect a counterclockwise rotation of both the camming rod 48 and the camming rod 51. The counterclockwise rotation of the camming rod 51 effects an articulation of the stitch tacking displacement shaft 35 in the same direction, so that the keying pins 50*a* and 50*b* engage the ends of the keying slots 26*a* and 26*b*, respectively, to thereby effect a counterclockwise pivoting of the platen levers 22*a* and 22*b* and, hence, a likewise pivoting of the platens 20*a* and 20*b* secured thereto. Additionally, the counterclockwise rotation of the camming rod 48 causes the toes 39*a* and 39*b* of the platens 20*a* and 20*b* to be biased against the presser foot, to thereby secure the fabric therebetween and prevent the fabric from being advanced by the reciprocating action of the rib and the feed stroke of the feeder. Accordingly, the fabric is not advanced between sewing operations, thereby permitting the stitches to be superimposed upon each other to effect a tacking operation. It is noted that further fine control of the amount of thread utilized for the stitch tacking operation can be effected by the pneumatic thread tensioner 13, in the same manner discussed above with respect to the stitch shortening operation.

A less complex mode of operation can be provided by limiting the displacement of the rubber stopper 65 to a first position, illustrated in FIG. 3, and a fully displaced position, illustrated in FIG. 5. In this mode of operation, a choice is made between selecting a stitch shortening operation or a stitch tacking operation by manually adjusting the positions of the camming rods 48 and 51, with respect to the rubber stopper 65. Specifically, if a stitch shortening operation is desired, the camming rod 51 can be repositioned out of the displacement path of the rubber stopper 65, thereby preventing any rotary displacement of shaft 35, and hence any pivoting of the platen assembly thereby when the rubber stopper is fully displaced. Alternatively, both camming rods 48 and 51 are positioned in the path of the rubber stopper 65, so that a tacking operation is obtained in response to the full displacement of the rubber stopper 65. Such an arrangement, however, requires a manual adjustment by the operator when it is desired to stitch between a stitch shortening mode of operation and a stitch tacking mode of operation.

Figure 8:
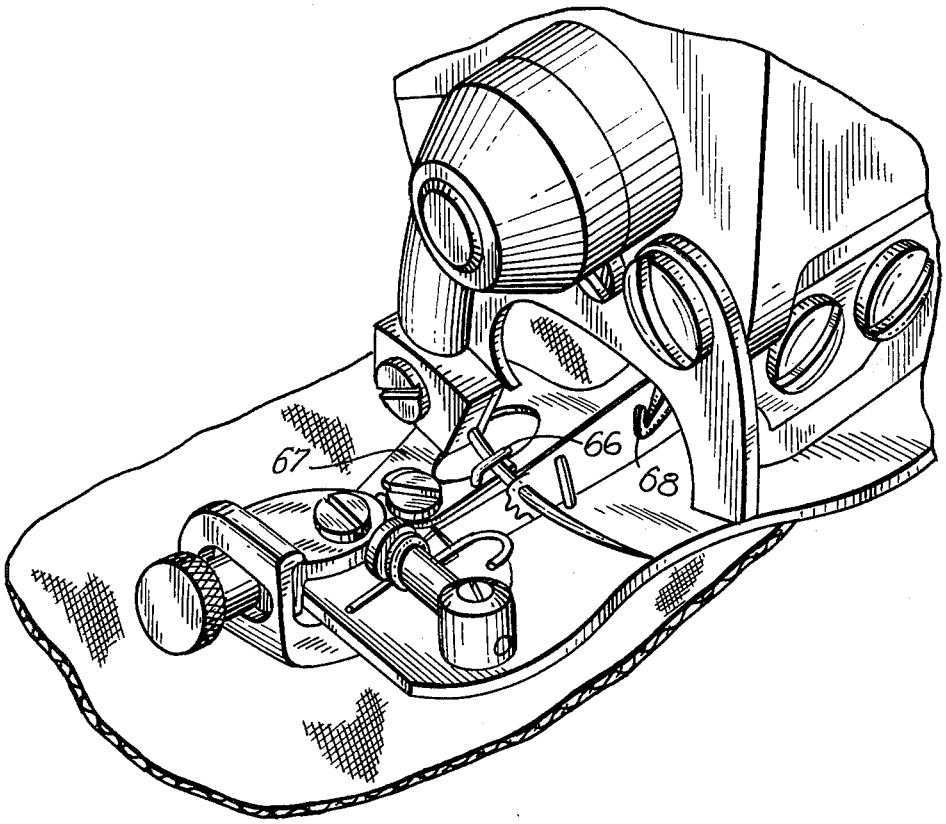
FIG. 8 is a perspective view of the needle assembly for use with the stitch shortening and tacking assembly of the instant invention.

The stitch shortening and tacking assembly of the instant invention is particularly characterized by the coordinate displacement of the platen between a normal advance position, wherein the flat guiding surface thereof is biased flush with the feeder during its feed stroke, a stitch shortening position, wherein the platen is lowered away from the feeder so that the only movement of the fabric is caused by lifting action of the rib, and a stitch tacking position, whereby the toe of the platen is biased against the presser foot in order to secure the material and assure that no advancement of same is effected. As is illustrated in FIG. 8, a chaining finger 66, is supported by a needle guide 67, in order to prevent stitches from being skipped when the stitch shortening and tacking assembly is operating in a stitch shortening mode. Specifically, when the stitch shortening and stitch tacking assembly is performing either a stitch tacking or stitch shortening operation, the increased thread tension placed on the looper 68, is likely to cause the thread loop to be missed by the needle during the blind stitch sewing operation. Accordingly, the chaining finger is provided to retain the thread loop in the path of the needle in order to prevent the needle from missing the loop and thereby causing a missed or skipped stitch.

It is noted that the term "fabric" as utilized in the specification, refers to any elongated web of material that can be sewn. Moreover, the stitch shortening and tacking assembly of the instant invention, although being particularly suited for use in blind stitch sewing machines, is also suitable for use in other sewing machines having a fabric feeding mechanism of the type found in blind stitch sewing machines.

By using the stitch shortening and stitch tacking assembly of the instant invention in a blind stitch sewing machine, stitch shortening and/or stitch tacking can be effected at any time during a sewing operation. Such shortening and tacking reinforces the stitches formed and, hence, reduces the likelihood of seam failure during handling of the sewn fabric.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statement of the scope of the invention which, as a matter of language, might be said to fall therebetween.

What is claimed is:

1. A variable stitching assembly for use with a sewing machine including a platen disposed in a first position for supporting a fabric during a sewing operation, a feeder constructed and arranged to be reciprocated through a feeding stroke, said feeder being adapted to engage said fabric against said platen when said platen is in said first position and said feeder is reciprocated through a feeding stroke to thereby advance said fabric through a first predetermined distance, needle means synchronized with respect to said feeder for stitching the fabric at the completion of each feeding stroke of said feeder, the improvement comprising a rib for lifting and selectively feeding arranged to be reciprocated in synchronism with said needle means through a lift stroke that is shorter than the feed stroke of said feeder, said rib being arranged to lift said web during said lift stroke, and first platen displacement means coupled to said platen for displacing same from said first position to a stitch shortening position out of engagement with said feeder during said feed stroke thereof so that said fabric is advanced by said rib during said lift stroke thereof a shorter distance than said first predetermined distance, thereby shortening the length of the stitch effected by said sewing operation.

2. A variable stitching assembly as claimed in claim 1, wherein said first platen displacement means includes an actuator means that is coordinately displaceable between a first position and a stitch shortening position, camming means coupled to said platen, said camming means being normally biased in a first position to maintain said platen in said first position, said camming means being constructed and arranged to be engaged by said actuating means and displaced into a stitch shortening position thereby so that said platen is displaced from said rest position to said stitch shortening position by said camming means.

3. A variable stitching assembly as claimed in claim 2, wherein said camming means includes a platen lever means for supporting said platen, a shaft, said platen lever means being secured to said shaft so as to be rotated thereby and a camming lever coupled to said shaft, said camming lever being constructed and arranged to be displaced by said actuating means and affect a rotation of said platen lever means and thereby displace said platen out of engagement with said feeder during each feeding stroke thereof.

4. A variable stitching assembly as claimed in claim 2, wherein said actuating means are pneumatic actuating means, said actuating means including a stoppr means constructed and arranged to engage said camming lever and displace same from a first position to a stitch shortening position.

5. A variable stitching assembly as claimed in claim 4, wherein said needle means includes a needle and thread processing means for supplying thread to said needle, said thread processing means including pneumatically operated thread tensioning means coupled to said pneumatic actuating means to selectively tension the thread supplied to said needle during each sewing operation when the stopper means is displaced into a stitch shortening position.

6. A variable stitching assembly as claimed in claim 5, wherein said needle is a curved needle for effecting a blind stitch sewing operation, and a finger is disposed proximate to the position of the needle and fabric when same effects a sewing operation for preventing the needle from skipping a stitch when the platen is disposed in a stitch shortening position.

7. A variable stitching assembly as claimed in claim 1, and including a presser foot constructed and arranged to permit fabric to be advanced between same and said platen when said platen is disposed in said first position, second tacking displacement pivot means constructed and arranged to coordinately displace said platen between said first position and said stitch shortening positions and a stitch tacking position whereby a portion of said platen is biased against said presser foot to thereby prevent said fabric from being advanced between sewing operations.

8. A variable stitching assembly as claimed in claim 7, wherein said second platen displacement means includes an actuator means that is coordinately displaceable between a first position, a stitch shortening position and stitch tacking position, camming means coupled to said platen, said camming means being normally biased in one of said first position and said stitch tacking position, said camming means being constructed and arranged to be engaged by said actuating means and displaced from one of said first position and stitch shortening position to said stitch tacking position so that said platen is disposed against said presser foot to prevent advancement of said fabric between sewing operations.

9. A variable stitching assembly as claimed in claim 8, wherein said camming means includes a platen lever means for supporting said platen, a shaft, said platen lever means being keyed to said shaft to be rotated thereby when said shaft is rotated from a stitch shortening position to a stitch tacking position, and a camming lever coupled to said shaft, said camming lever being constructed and arranged to effect displacement of said platen lever means to said stitch tacking position whereby said platen is biased against said presser foot to prevent said fabric from being advanced during each stitch tacking operation.

10. A variable stitching assembly as claimed in claim 8, wherein said actuating means is a pneumatic actuating means, and includes a stopper means constructed and arranged to engage said camming means and displace same from one of a first position and stitch shortening position to a stitch tacking position.

11. A variable stitching assembly as claimed in claim 7, wherein said platen includes a substantially flat guiding surface adapted to be engaged with said feeder when said platen is disposed in a first position, said platen including a toe, said toe being biased against said presser foot when said platen is disposed in said stitch tacking position.

12. A variable stitching assembly as claimed in claim 7, and including actuator means coordinately displaceable between a first position, a stitch shortening position and a stitch tacking position, first stitch shortening camming means coupled to said platen, and second stitch tacking camming means coupled to said platen, said stitch tacking camming means and said stitch shortening camming means being normally biased in a first position to maintain said platen in said first position, both said camming means being arranged to be engaged by said actuating means and displaced into stitch tacking and shortening positions, said stitch shortening camming means being adapted to displace said platen into said stich shortening position in response to being displaced to a stitch shortening position by said actuator means, said stitch tacking camming means being adapted to displace said platen to said stitch tacking position when said actuator means displaces said stitch tacking camming means into said stitch tacking position.

13. A variable stitching assembly as claimed in claim 12, wherein said stitch shortening camming means includes a first shaft, said stitch tacking camming means includes a second shaft, and a platen lever means secured to said first shaft to be rotated thereby, said platen lever means being arranged to be rotated by said second shaft when said stitch tacking camming means is displaced from a stitch shortening position to a stitch tacking position, said platen lever means being arranged to transmit the rotary motion of said shafts to said platen, so that displacement of said camming means by said actuating means effects a rotation of said platen lever means to thereby displace said platen from a first position to a stitch shortening position in response to said actuating means displacing said stitch shortening camming means from a first position to a stitch tacking position, and for displacing said platen from said stitch shortening position to said stitch tacking position in response to said actuator means displacing said stitch tacking camming means and said stitch shortening camming means from said stitch shortening position to said stitch tacking position.

14. A variable stitching assembly for use with a sewing machine including a platen disposed in a first position for supporting a fabric during a sewing operation, a presser foot, including a feeder opening formed therein, a feeder disposed in said feeder opening formed in said presser foot, said feeder being arranged to be reciprocated through a feeding stroke, said feeder being adapted to engage said fabric against said platen when said platen is in said first position and said feeder is reciprocated through a feeding stroke to thereby advance said fabric, needle means synchronized with respect to said feeder for stitching the fabric at the completion of each feeding stroke of said feeder, the improvement comprising first platen displacement means coupled to said platen for displacing same from said first position to a stitch tacking position so that a portion of said platen is biased against said presser foot to thereby prevent said fabric from being advanced between sewing operations.

15. A variable stitching assembly as claimed in claim 14, wherein said platen displacement means includes an actuator means that is coordinately displaceable between a first position and a stitch tacking position, camming means coupled to said platen, said camming means being normally biased in said first position to maintain said platen in said first position, said camming means being constructed and arranged to be engaged by said actuating means and displaced into a stitch tacking position so that said platen is displaced from said rest position into said stitch tacking position by said camming means.

16. A variable stitching assembly as claimed in claim 15, wherein said camming means includes platen lever means for supporting said platen, a shaft, said platten lever means being secured to said shaft to be rotated thereby, and a camming lever coupled to said shaft so that the displacement of said camming lever by said actuating means effects a rotation of said platen lever means to thereby bias said platen against said presser foot and prevent said fabric from being advanced between sewing operations.

* * * * *